US007061443B2

(12) United States Patent
Lee et al.

(10) Patent No.: US 7,061,443 B2
(45) Date of Patent: Jun. 13, 2006

(54) MMW ELECTRONICALLY SCANNED ANTENNA

(75) Inventors: Jar J. Lee, Irvine, CA (US); Steven R. Wilkinson, Stevenson Ranch, CA (US); Robert A. Rosen, Simi Valley, CA (US); Kapriel V. Krikorian, Calabasas, CA (US); Irwin L. Newberg, Pacific Palisades, CA (US)

(73) Assignee: Raytheon Company, Waltham, MA (US)

( * ) Notice: Subject to any disclaimer, the term of this patent is extended or adjusted under 35 U.S.C. 154(b) by 60 days.

(21) Appl. No.: 10/815,274

(22) Filed: Apr. 1, 2004

(65) Prior Publication Data

US 2005/0219135 A1 Oct. 6, 2005

(51) Int. Cl.
*H01Q 13/10* (2006.01)

(52) U.S. Cl. ..... 343/770; 343/754; 343/776

(58) Field of Classification Search ..... 343/754, 343/770, 771, 772, 776, 909
See application file for complete search history.

(56) References Cited

U.S. PATENT DOCUMENTS

| | | | | |
|---|---|---|---|---|
| 5,266,961 | A | 11/1993 | Milroy | |
| 5,905,472 | A | 5/1999 | Wolfson et al. | |
| 5,926,077 | A | 7/1999 | Milroy | |
| 5,995,055 | A | 11/1999 | Milroy | |
| 6,075,494 | A | 6/2000 | Milroy | |
| 6,101,705 | A | 8/2000 | Wolfson et al. | |
| 6,157,347 | A * | 12/2000 | Robertson | 343/772 |
| 6,421,021 | B1 * | 7/2002 | Rupp et al. | 343/753 |

OTHER PUBLICATIONS

1999 IEEE MIT-S Digest, TU4B-2, "W-Band CTS Planar Array," by Lemons et al, pp. 651-654.

* cited by examiner

*Primary Examiner*—Shih-Chao Chen
(74) *Attorney, Agent, or Firm*—Leonard A. Alkov; Karl A. Vick

(57) ABSTRACT

A millimeter wave (MMW) antenna array includes a continuous transverse stub (CTS) radiating aperture comprising a set of spaced continuous transverse stubs, each having a longitudinal extent. A series feed system is coupled to an excitation source for exciting the stubs with MMW electromagnetic energy having a linear phase progression along the longitudinal extent of the stubs to produce an array beam which can be scanned over a beam scan range by changing the excitation frequency.

16 Claims, 9 Drawing Sheets

MMW ELECTRONICALLY SCANNED ANTENNA

BACKGROUND

Electronically scanned antennas for micro-millimeter-wave (MMW), or W-band, typically above 35 Ghz, applications are traditionally expensive to build and very few have been developed. The ones that have been demonstrated are generally implemented as a microstrip patch or slot array. The packaging constraints and the costs associated with the electronics of these conventional approaches make a fully populated discrete array impractical. Additionally, these designs require many levels of lossy feed networks, and the tolerance is so tight that the production cost can be relatively high. Aperture efficiency is always an issue at W-band.

SUMMARY OF THE DISCLOSURE

A millimeter wave (MMW) antenna array includes a continuous transverse stub (CTS) radiating aperture comprising a set of spaced continuous transverse stubs, each having a longitudinal extent. A feed system is coupled to an excitation source for exciting the stubs with MMW electromagnetic energy having a linear phase progression along the longitudinal extent of the stubs to produce an array beam which can be scanned over a beam scan range.

BRIEF DESCRIPTION OF THE DRAWINGS

Features and advantages of the disclosure will readily be appreciated by persons skilled in the art from the following detailed description when read in conjunction with the drawing wherein:

FIG. 5A shows the aperture 110 in simplified diagrammatic fashion; FIG. 5B shows three subarrays of the ESA with a corresponding portion of a series feed network.

DETAILED DESCRIPTION

Figure 1:
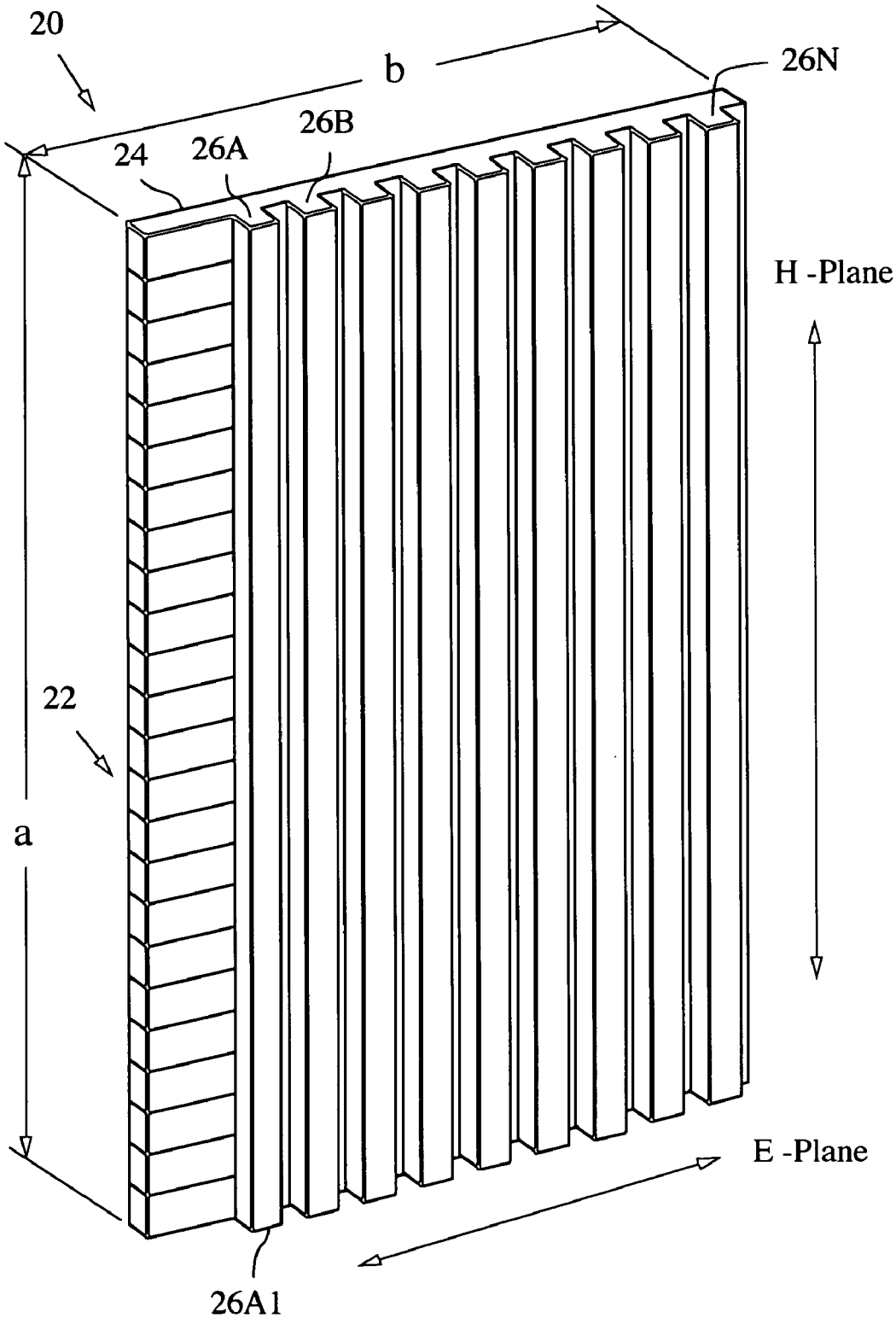
FIG. 1 is a simplified diagrammatic view of a CTS (continuous transverse stub) subarray panel structure.

In the following detailed description and in the several figures of the drawing, like elements are identified with like reference numerals.

An exemplary embodiment of an electronically scanned antenna (ESA) employs CTS (continuous transverse stub) subarray panels for the aperture, which are relatively easy to build and low cost. An exemplary W-band subarray panel 20 is shown in FIG. 1; the panel can be constructed to fit within a two inch by two inch area. A CTS structure is described in U.S. Pat. No. 5,266,961, "Continuous Transverse Stub Element Devices and Methods of Making Same," the entire contents of which are incorporated herein by reference. The array structure 20 is fabricated in this example as a metallized plastic wave guide structure, wherein a dielectric structure has metal layers plated thereon. The structure 20 includes an input edge 24, and a plurality of continuous transverse stubs 26A . . . 26N. The transverse edge surfaces of the stubs, for example, edge surface 26A1 of stub 26A, are not metallized, allowing electromagnetic energy to propagate through this edge of each stub.

FIG. 1 illustrates a CTS subarray fed by a line source along the edge. The line source in this example is a linear array 22. A parallel plate mode can be launched within the waveguide structure 24 by the line source 22. The waveguide structure is a parallel plate structure, e.g. a metallized plastic structure in one embodiment, which supports a traveling wave, and serves as a planar feed and radiating aperture. The quasi-TEM mode propagates with longitudinal electric currents which are interrupted by the continuous transverse stubs 26A, 26B . . . 26N, thereby exciting a displacement current across the stubs. The induced displacement current in turn excites equivalent E-fields at the surfaces of the stubs and radiates EM waves into free space. Thus, by loading the end of the CTS aperture and feeding the CTS with a line source, a traveling-wave fed antenna is formed.

Using appropriate stub geometry, a suitable distribution can be realized to achieve a desirable radiation pattern and side lobe levels. At W-band, at 96 GHz, a fully populated conventional array on the size order of two inches by two inches would require over 1000 discrete elements, but an exemplary embodiment of the CTS aperture employs only about 30 stubs. This dramatic part count reduction, along with the one-piece construction of the CTS aperture in an exemplary embodiment, leads to a corresponding reduction in production cost of a W-band MMW antenna.

A 94 GHz CTS subarray is described in "W-band CTS Planar Array." Lemons, A.; Lewis, R.; Milroy, W.; Robertson, R.; Coppedge, S.; Kastle, T. Microwave Symposium Digest, 1999 IEEE MTT-S International, Volume: 2, 1999, Page(s): 651–654 vol.

One of the advantages of using a CTS aperture is its inherent tolerance to manufacturing errors. For most traveling-wave fed designs, the stub coupling (the amount of power coupled to free space) for each individual stub can vary by as much as 1 dB without seriously degrading the array performance. Moreover, 30% errors in dielectric constant of the plastic materials from which an exemplary CTS waveguide structure is fabricated translates to less than 0.6 dB change in stub coupling. These relatively large allowable errors relax the tolerances, e.g. to ±0.025 mm at 94 Ghz in an exemplary embodiment, compared to much tighter manufacturing tolerances (±0.013 mm) as usually required for other planar array architectures (e.g. slotted planar arrays) operating at 94 GHz.

Figure 2:
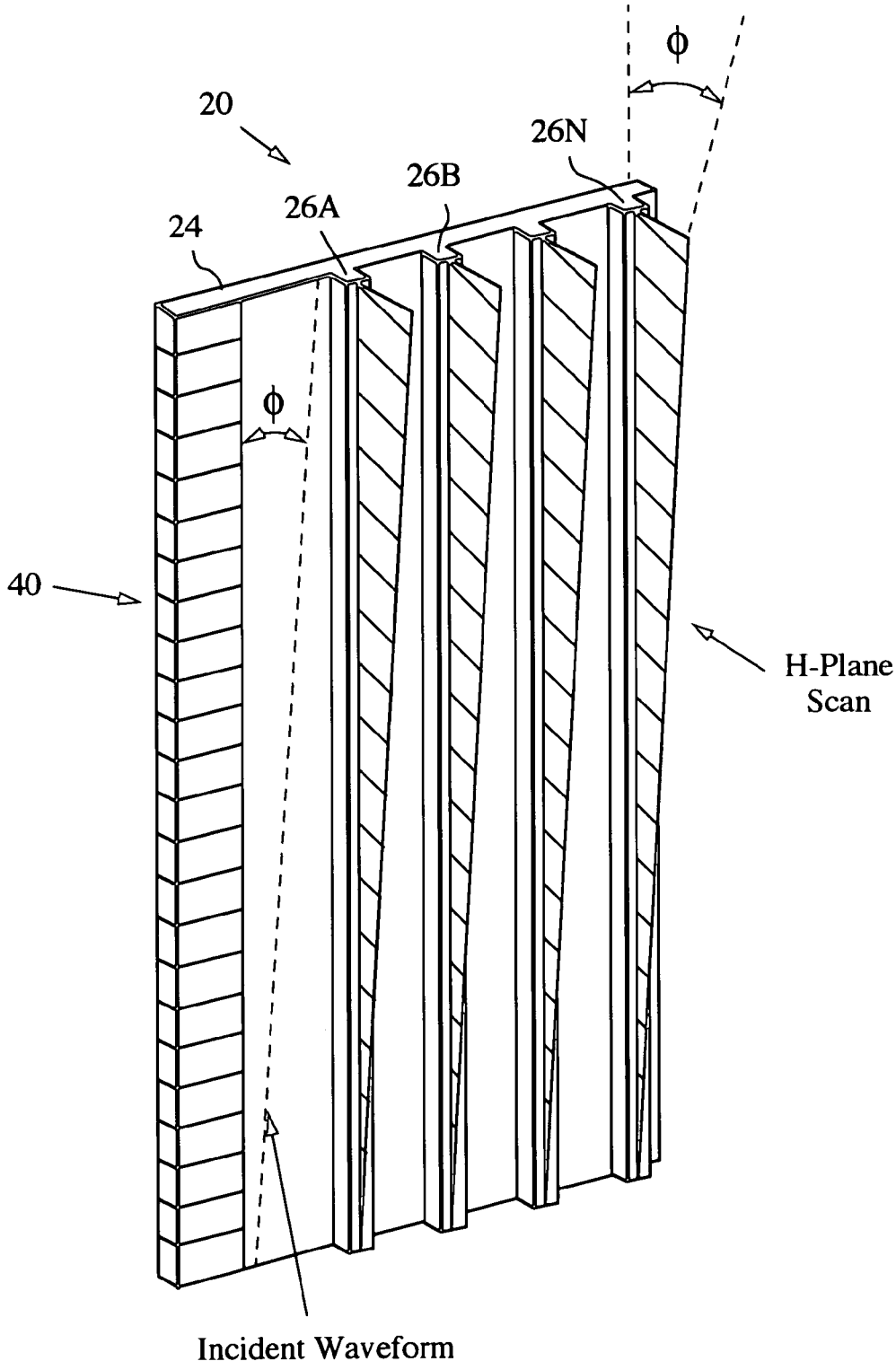
FIG. 2 is a simplified diagrammatic view of a CTS subarray with H-plane scanning.

In accordance with an aspect of the invention, an electronically scanned antenna comprising the CTS subarray is provided. The concept of beam scan in the H-plane of the CTS antenna 20 is illustrated in FIG. 2. A line source 40 with phase control launches a quasi-TEM wave into the parallel plate structure 24. This traveling wave will be coupled into the stubs 26A, . . . 26N, and radiated into free space. By controlling the tilt angle θ of the incident wave front 42 in the parallel plate region, the radiated beam can be scanned in the H-plane of the CTS antenna. The scanned angle $\phi$ at the exit plane is determined by Snell's law associated with the air/dielectric interface of the stubs.

Figures 3A, 3B:
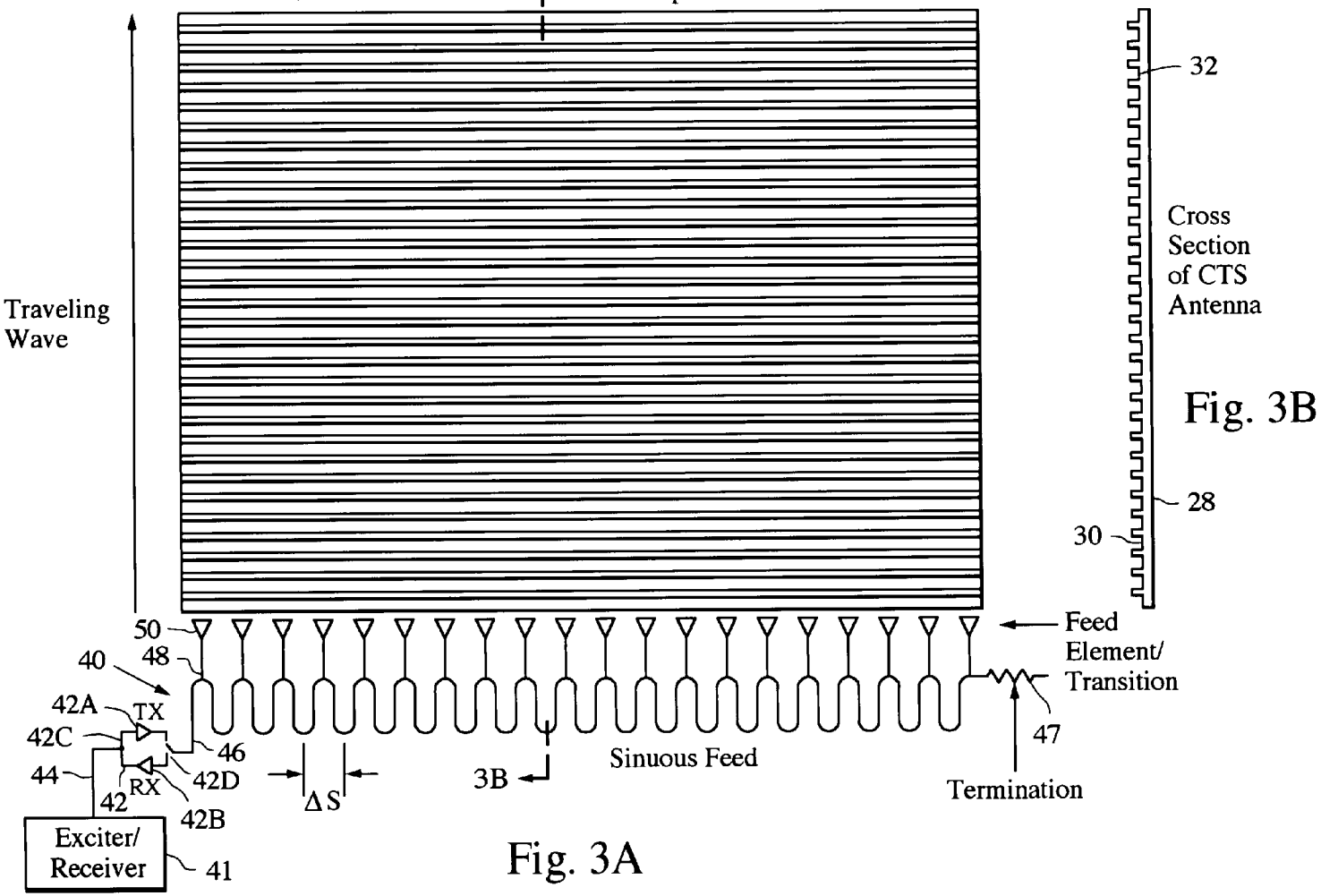
FIG. 3A illustrates a CTS antenna subarray with a serpentine feed.
FIG. 3B shows a cross-section of the CTS antenna subarray taken along line 3B—3B of FIG. 3A.
Figure 4:
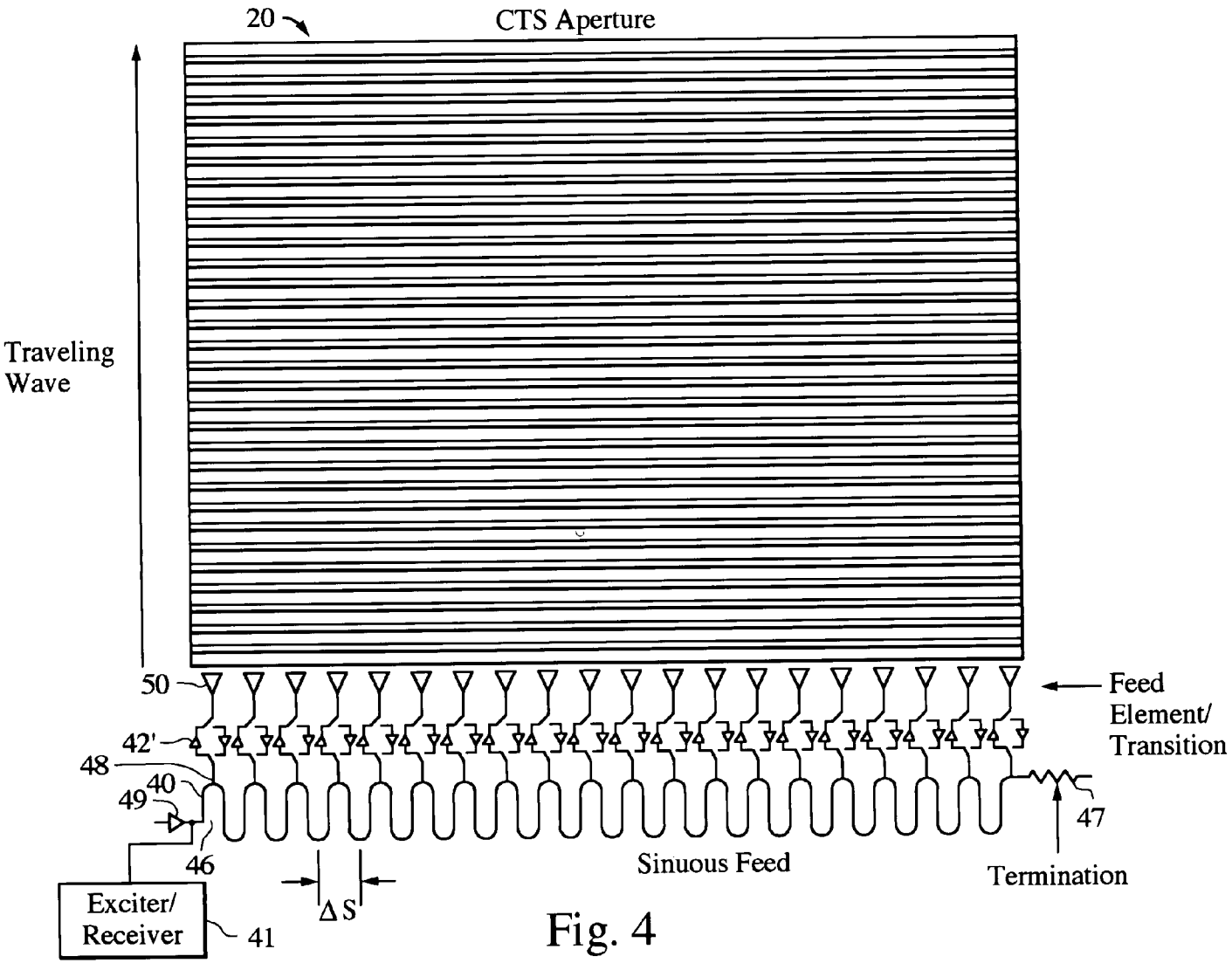
FIG. 4 shows an alternate embodiment of a serpentine feed system for a CTS subarray.

For MMW antennas, using discrete phase shifters to steer the beam is not practical because of the element spacing of the line source is extremely small (~2.5 mm at 94 GHz) and the cost of digital beam control is prohibitively high. Instead, for simplicity, an exemplary embodiment uses a serpentine feed with couplers to provide a linear progressive phase shift along the line source. The embodiment is shown in FIG. 3A, in which a medium power T/R module 42 is used to support a subarray 20. On the other hand, if low power amplifiers and LNA's are available and become cost effective, a distributive approach such as shown in FIG. 4 may be employed.

The serpentine feed 40 is schematically illustrated in FIG. 3A, with FIG. 3B showing a cross-section of the CTS antenna subarray 20. The feed 40 has an I/O port 46 connected to an I/O port of the T/R module 42, and the distal end of the serpentine feed is connected to a load termination 47. The module 42 includes transmit amplifier 42A and receive amplifier 42B, and a pair of switches 42C, 42D which operate to select either the transmit channel or the receive channel. The module 42 is connected to the I/O port 44, which carries either a transmit signal from an exciter to the transmit channel, or a received signal from the receive channel, to be passed to a system receiver/processor. For simplicity, FIG. 3A shows system 41 as an exciter and receiver system. The exciter can be operated to provide an output signal which is scannable over a frequency range of operation.

The serpentine feed 40 provides a sinuous transmission line with spaced ports 48 for connection to the feed elements 50 through an RF transition or coupler. In an exemplary embodiment, the serpentine feed is fabricated as a sinuous waveguide structure, and the feed elements 50 are openings formed in the conductive plating of the waveguide structure. The feed elements are spaced apart by a distance $\Delta S$, which in an exemplary embodiment is $\frac{1}{2}\lambda_0$ at a center operating frequency. Due to the sinuous nature of the waveguide feed, the effective electrical length between feed elements along the serpentine structure is nominally $\lambda_0$ at a center operating frequency. In this embodiment, the array will produce a beam at broadside with an excitation signal at the center frequency, e.g., 35 Ghz. The beam can be scanned in the H-plane by changing the excitation frequency in the series feed, e.g. by changing the frequency of the exciter signal over a scan range, e.g. over an exciter frequency range between 34 GHz and 36 GHz. The phase at the respective feed elements follows a linear progressive function as the frequency is scanned away from the center, since the transmission line lengths between the elements is no longer equivalent to the wavelength of the operating frequency, and due to the equal transmission line lengths between the elements.

FIG. 3B shows in a simplified fashion the wave guide structure of the array 20. The wave guide structure includes an upper conductive plate structure 30 defining the set of continuous transverse stubs, and a lower conductive plate structure 28 disposed ma spaced relationship relative to the upper plate structure to define the wave guide region 32 in which the parallel plate mode, traveling wave propagates. In one exemplary embodiment, the region 32 is filled with a dielectric, and the structures 30, 28 are formed by plating external surfaces of the dielectric with metal. In other embodiments, the structures 30, 28 can be self-supporting plate structures, and the region 32 either air-filled or dielectric-filled. An exemplary dielectric material suitable for the purpose is Rexolite™, with a relative dielectric constant of $\in_r$. While FIG. 3B shows the bottom plate structure 28 as generally parallel to the upper plate structure 30, this is not required; for some applications, tome tilt may be employed.

FIG. 4 shows an alternate embodiment of a serpentine feed system for a CTS subarray 20. This embodiment includes a serpentine transmission feed network 40 as in the embodiment of FIG. 3A. In this embodiment, each feed element 50 has associated with it a separate T/R module 42'. Thus, an I/O port of the T/R module 42' is connected to the transition port 48; the feed element 50 is connected to the radiator port of the T/R module 42'. An exciter and receiver system 41 is connected to the I/O port 46 of the serpentine feed 40.

An MMW ESA in accordance with aspects of the invention is useful for many applications, including military aviation, tank radars for IFF, maritime collision avoidance, ground vehicles and manportable surveillance. In an exemplary application, the ESA can be adapted for commercial aviation needs. An exemplary embodiment can be designed to meet the following specifications based on a system analysis performed for a landing aid radar:

| | |
|---|---|
| Frequency | 94 GHz |
| Bandwidth | +/−1 GHz (2 GHz) |
| EL Scan | ~+/−2 Deg |
| AZ Scan | ~+/−15 Deg |
| Aperture Size | 10 cm × 75 cm |
| Scan Rate | >30 Hz in AZ |
| Polarization | Vertical |

Figure 5A:
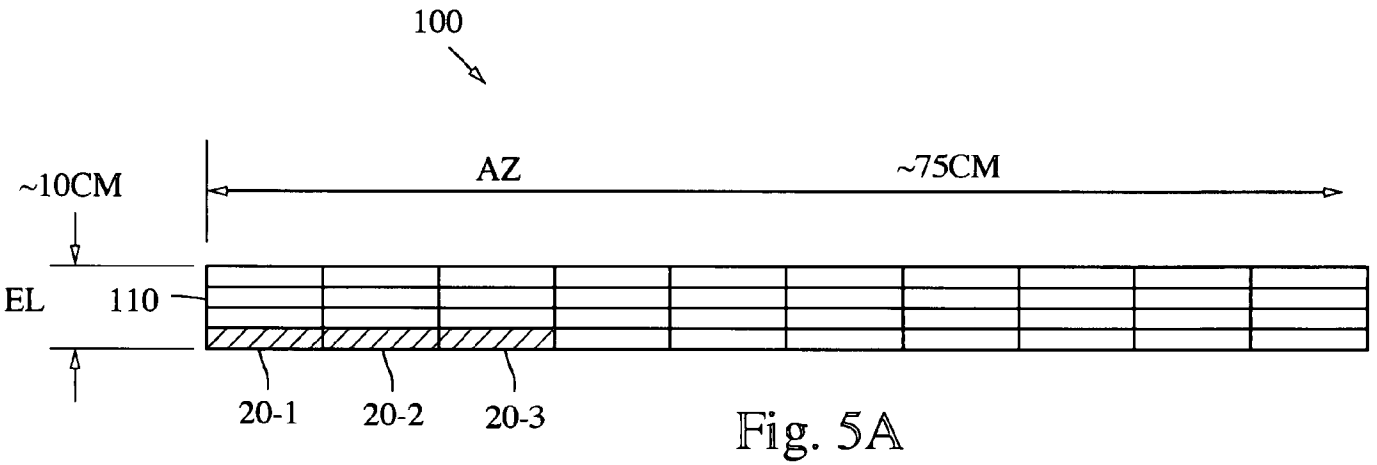
FIGS. 5A–5B shows an exemplary configuration of a W-band ESA for landing air radars.
Figure 5B:
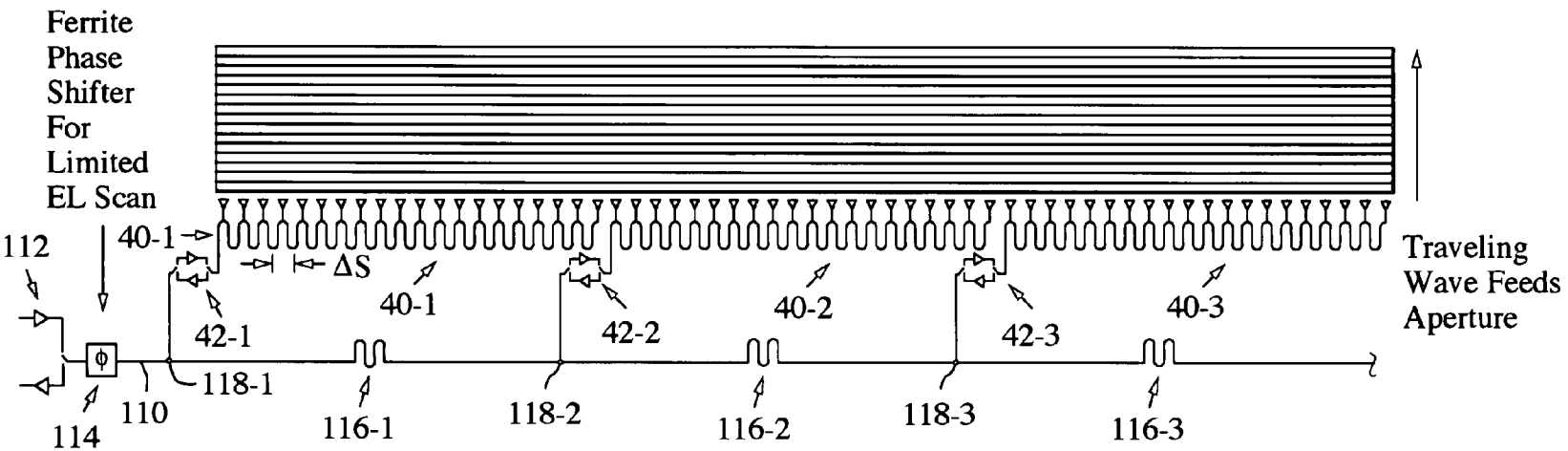

FIGS. 5A–5B shows an exemplary configuration of a W-band ESA 100 for landing air radars. It includes an aperture 110 with a number of subarray panels 20-1, 20-2, . . . in the elevation (EL) and azimuth (AZ) planes. FIG. 5A shows the aperture 110 in simplified diagrammatic fashion; FIG. 5B shows three subarrays 20-1, 20-2, 20-3 with a corresponding portion of a series feed network 110. The number of subarrays in the AZ-plane depends on the power source available and how well the RF loss in the serpentine feed can be controlled. At W-band, the insertion loss of a WR-10 waveguide is about 1 dB per 30 cm. The series feed for each subarray in an exemplary embodiment should preferably not be too long, e.g. less than about 90 cm, to keep the average loss down to 1.5 dB level. In this embodiment, the length of the array in the AZ plane is on the order of 75 cm, with ten subarrays along the AZ plane. The number of subarrays in the EL-plane is chosen to ensure that the subarray is small enough to provide a broad EL pattern. This is desired to prevent excessive gain roll-off when the overall beam is scanned off over a limited range, e.g. to compensate for the pitch and roll of the aircraft during landing. In this exemplary embodiment, there are four subarrays in the EL plane, with a total height on the order of 10 cm.

A series feed 110 is used to feed the plurality of serpentine feeds 40-1, 40-2, 40-3 for the array system 100. The series feed network 110 includes at its I/O port a T/R module 12, and a ferrite phase shifter 114 which can be used to provide a limited El scan capability. The network 110 further includes couplers 118-1, 118-2, 118-3 . . . which couple a portion of excitation power to the respective subarrays. Each of the couplers is connected to the serpentine feed network for the corresponding subarray through a T/R module 42-1,

42-2, 42-3 . . . . The feed 110 further includes a plurality of delay lines 116-1, 116-2, 116-2 following the couplers to provide desired time delays in the signals provided to each subarray.

To scan the beam 15 degrees in AZ for the embodiment of FIG. 5A, a differential phase shift of 74 deg per element is needed in the serpentine feed. The differential phase shift is $(2\pi/\lambda)(d)(\sin(\theta))$, where $\theta$ is the scan limit. For a 15 degree scan limit, the element spacing d is 9.8$\lambda$ to avoid grating lobes, which equates to a required differential phase shift of 74 degrees. This can be achieved with 1 GHz sweep over an incremental delay of about 4 cm in fiber or wave guide with an index of refraction n~1.5, from one port to the next of the serpentine feed. The formula used to calculate the delta length is $$\Delta L = \frac{\Delta\varphi C}{360 n \Delta f}$$

where C is the speed of light, $\Delta\phi$ is the differential phase shift required for the scan, and $\Delta f$ is one-side frequency sweep to produce the progressive phase shift along the series feed in each subarray.

To maintain a coherent phase front among the subarrays in the AZ-plane, a delay line equal to the electrical length of the serpentine may be inserted between two adjacent subarrays. Exemplary delay lines are shown in FIG. 5B as 116-1, 116-2 and 116-3. Well trimmed delay lines will provide a precise continuous phase slope to all the subarrays for coherent beam forming. Additional driver circuits may be used to overcome the RF loss of the delay lines in the feed network for some applications. The delay lines may be implemented with optical fibers, printed microstrip line, or meandered wave guide. The photonic method requires a photo-detector and laser to convert the optical signal into RF and vice versa on the transmit and receive respectively.

Figure 6:
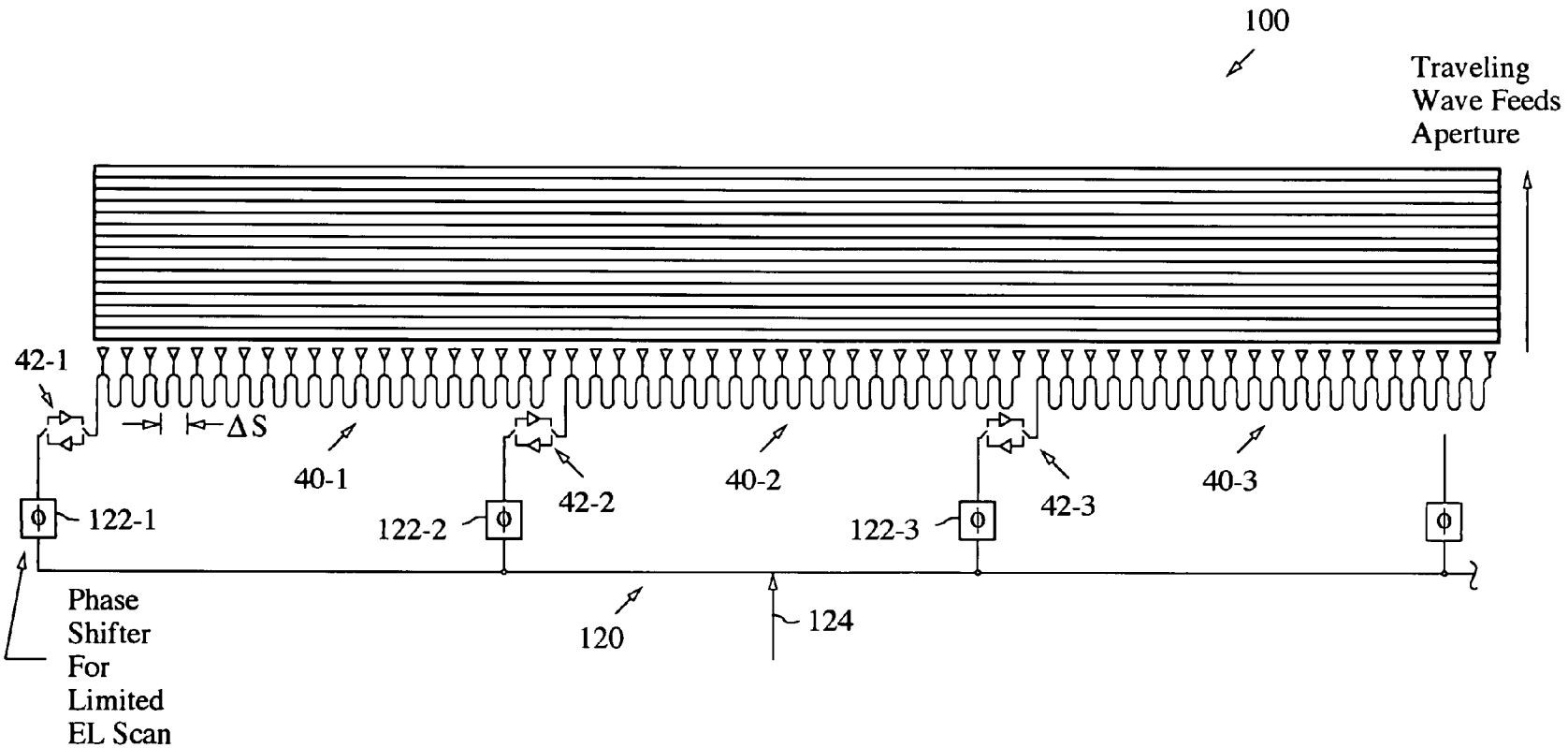
FIG. 6 shows a further alternate embodiment of an ESA.

An alternate embodiment of the ESA is shown in FIG. 6, where the delay lines 116-1, 116-2, 116-3 . . . are replaced by phase shifters 122-1, 122-2,122-3 . . . . A corporate feed network 120 couples an I/O port 124 to the respective phase shifters. The phase shifters are in turn connected to the T/R modules 42-1, 42-2, 42-3 . . . and the serpentine feeds 40-1, 40-2, 40-3 for the subarray columns. One advantage of this variation is that no lossy delay lines are required and the phase inputs can be generated at lower frequency with precision before up conversion. The penalty, however, is the need to synchronize and phase track all the phase shifters for all the subarrays over the frequency band.

Figure 7:
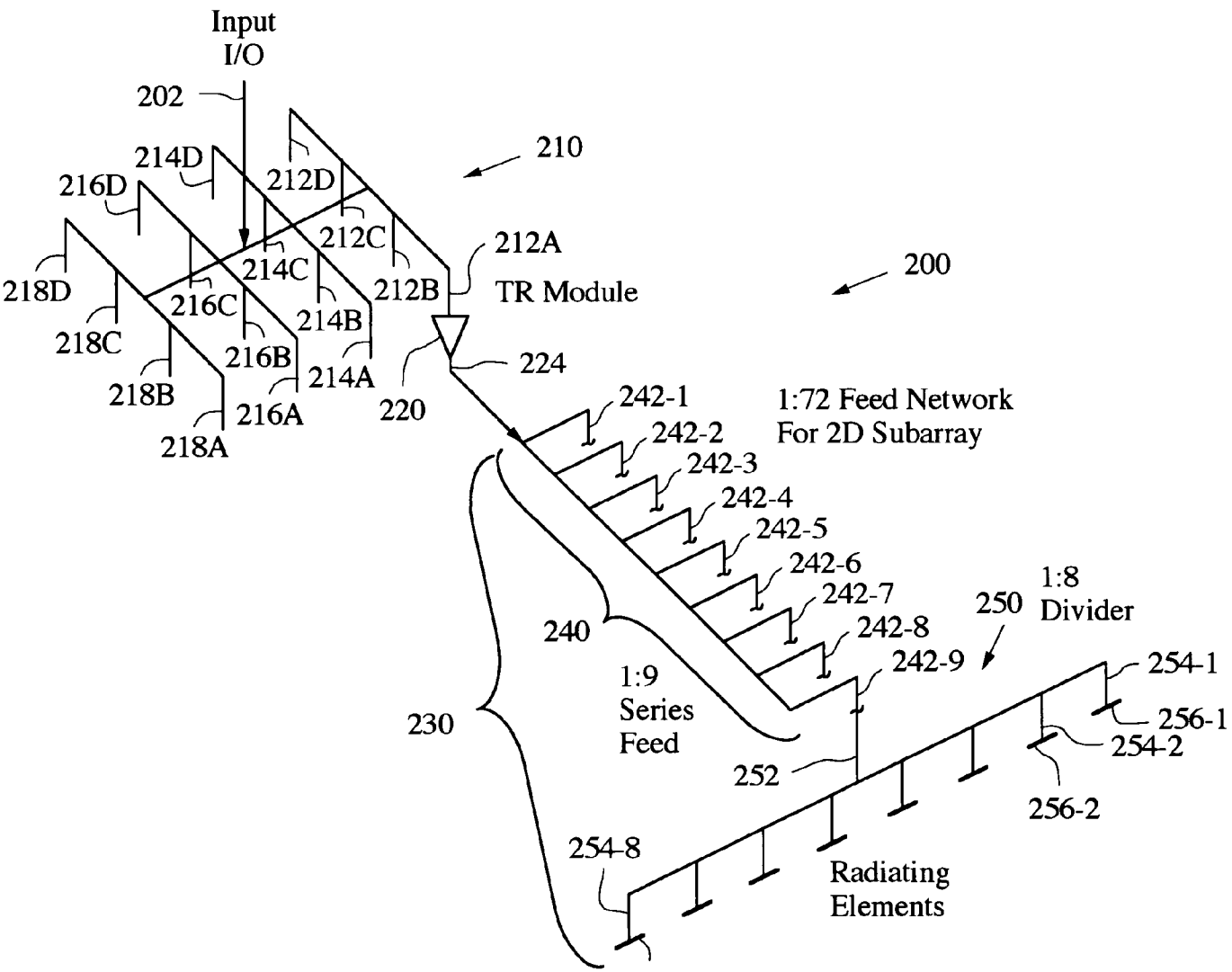
FIG. 7 is a schematic diagram of an alternate feed network for an CTS ESA.

FIG. 7 is a schematic diagram of an alternate feed network 200 for a CTS ESA. In this example, there are 32 radiating stubs in the array, fed by 16 subarrays of radiating elements, the subarrays arranged in a 4×4 arrangement in a distributed corporate feed network, to provide a wider bandwidth. The feed network has an input/output (I/O) port 202, which is coupled to a 1:N divider network 210 whose output/input ports 212A–212D, 214A–214D, 216A–216D, 218A–218D feed the respective 16 subarrays. In this embodiment, ports 212A–212D are connected to N series feeds distributed along a common set of stubs, so that the longitudinal extents of this set of the radiating stubs are excited by signals from the ports 212A–212D. Similarly, ports 214A–214D, 216A–216D and 218A–218D respectively excite three other sets of stubs. The network 210 provides equal power to the sixteen output/input ports, but the phases progressively increase for each port in a given set, to provide a linear phase progression along the longitudinal extents of the stubs. Thus, for example, the phase of the port signals 212A–212D progressively increases from 212A–212D. The phase at ports 212A, 214A, 216A and 218A are identical, as is the phase are corresponding ports 212B, 214B, 216B, 218B, and so on.

Each of the 16 output/input (O/I) ports of network 210 is coupled to a Transmit/Receive (T/R) module which is coupled to a respective subarray feed network. For example, O/I port 212 is coupled to an I/O port of T/R module 220; the O/I port 224 of the module is coupled to a 1:72 subarray feed network 230, comprising a 1:M, where M=9, series divider feed network 240 with 9 O/I ports, each of which is coupled to a 1:K, where K=9, divider network 250. For example, 1:8 divider network 250 is connected to O/I port 242-9 of the 1:9 series divider feed 240, and divides a feed signal at I/O port 252 into 8 in-phase, equal power signals at O/I ports 254-1 . . . 254-8, which are connected to radiating elements 256-1, . . . 256-8, one for each of eight slots (not shown in FIG. 9). Thus, in this example, the array has 32 slots excited by sixteen subarrays, with nine excitation points along each slot at nominal ½$\lambda$ (at center frequency) spacing.

The feed network shown in FIG. 7 can also be used without the CTS array. In this case, the radiating elements 256-1 . . . 256-8 for each subarray defines the radiating aperture, and are formed as shown in an array of rows and columns. At center frequency, a beam is produced at broadside; as the frequency is scanned away from the center frequency, the linear phase progression resulting from the frequency change scans the beam away from broadside.

Figure 8:
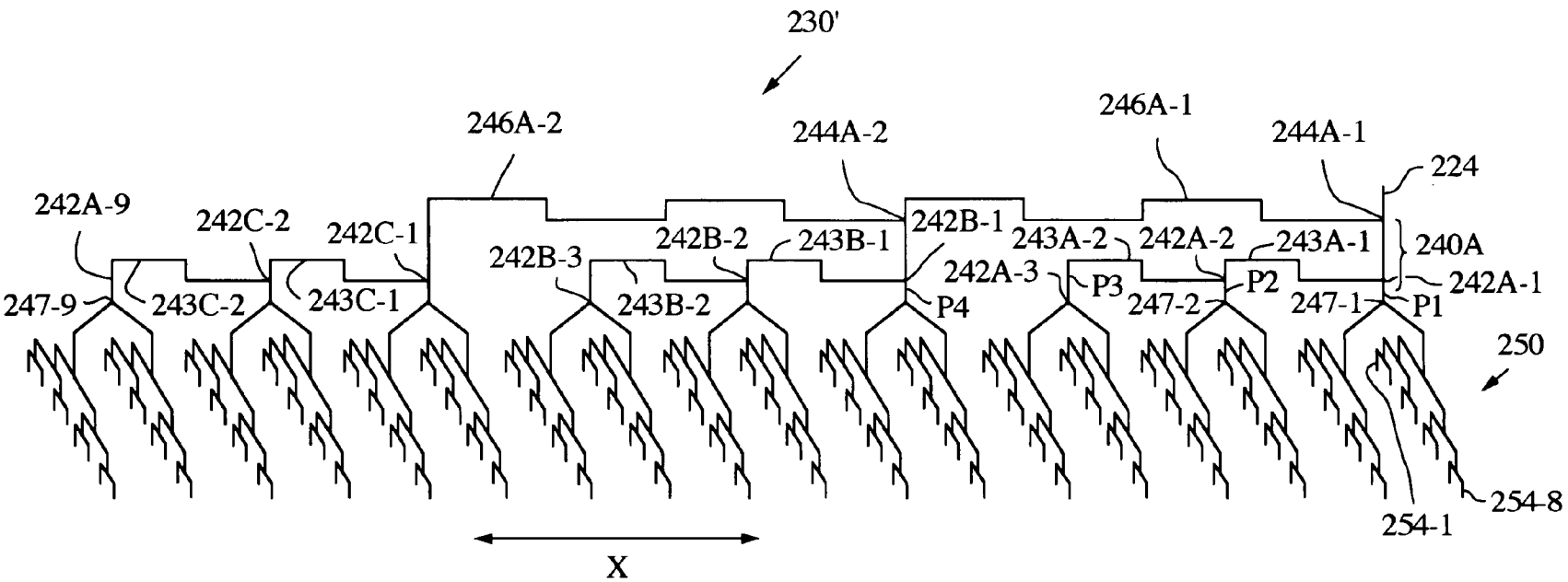
FIG. 8 shows a schematic diagram of an exemplary embodiment of a 1:144 feed network.

FIG. 8 shows a schematic diagram of an exemplary embodiment of a 1:144 feed network 230', which differs from the 1:72 network 230 of FIG. 7 in that there are 18 points of excitation along each slot instead of 9 points. The slots to be excited by the feed network are arranged with longitudinal extents along or parallel to an X axis, with the 18 points of excitation along each slot, spaced at about ¼ $\lambda$ at the center frequency of operation. The network 230 includes a 1:9 feed network 240A, which comprises a 1:3 network comprising a first 1:2 divider circuit 244A-1, a second 1:2 divider circuit 244A-2 coupled to a first output of the first 1:2 divider circuit by a transmission line 246A-1, and a transmission line 246-2 coupled to a second output of the second 1:2 divider circuit. The electrical lengths of lines 246A-1 and 246A-2 are selected to provide a delay of 360° or an integer multiple thereof, at the center frequency of operation, so that the signals at the dividers 244A-1 and 244A-2 and at the distal end of the transmission line 246A-1 are in-phase at the center frequency.

Each of the outputs of the 1:3 network are again divided into three paths by respective 1:2 divider circuits 242A-1 and 242A-2, 242B-1 and 242B-2, and 242C-1 and 242C-2 to provide nine O/I ports P1–P9 of the network 240A. The power division ratios of the respective 1:2 divider circuits are selected to provide equal power to each O/I port. The electrical lengths of each of the transmission lines 243A-1, 243A-2, 243B-1, 243B-2 and 243C-1 and 243C-2 are selected to provide a delay of 360° or an integer multiple thereof, at the center frequency of operation, so that the signals at the ports P1–P9 are in-phase at the center frequency.

Each of the O/I ports P1–P9 in this embodiment is connected to a 1:2 equal power, in-phase divider circuit 247-1, 247-2 . . . 247-9, whose outputs each is provided to a 1:8 divider circuit, e.g. circuit 250 connected to port 242A-1, which in turn feeds a respective radiator through a path 254-1 . . . 254-8.

At the center frequency of operation, the resulting beam is at broadside, with the excitation signals in-phase at all excitation points along the respective slot. As the frequency is varied above or below the center frequency, the signals at the excitation points are no longer in phase, since the effective electrical lengths of the transmission lines comprising the feed network have shifted. This results in scanning of the beam away from broadside as the frequency is scanned away from the nominal center frequency of operation.

It is noted that the radiators connected to a common divider circuit 247-1, . . . 247-9 are excited in phase even as the frequency is scanned, if the line lengths connecting them to the divider outputs are equal.

Figure 9:
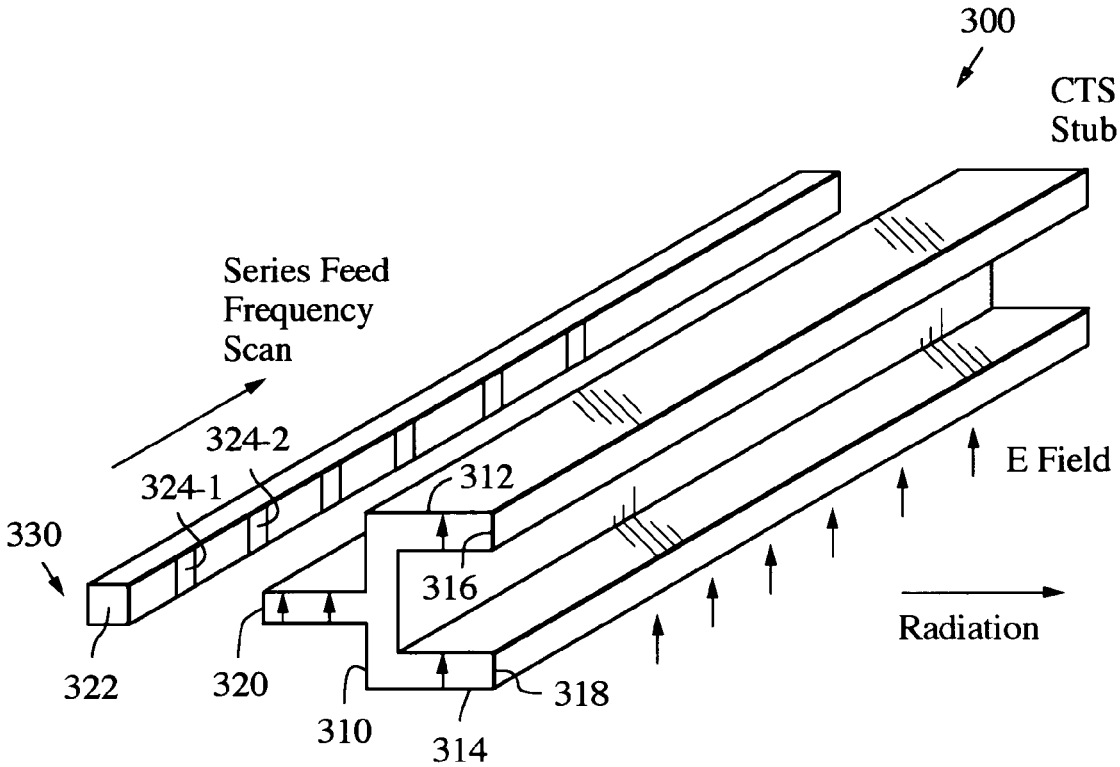
FIG. 9 is an isometric view of a simplified subarray structure comprising two stubs.
Figure 10:
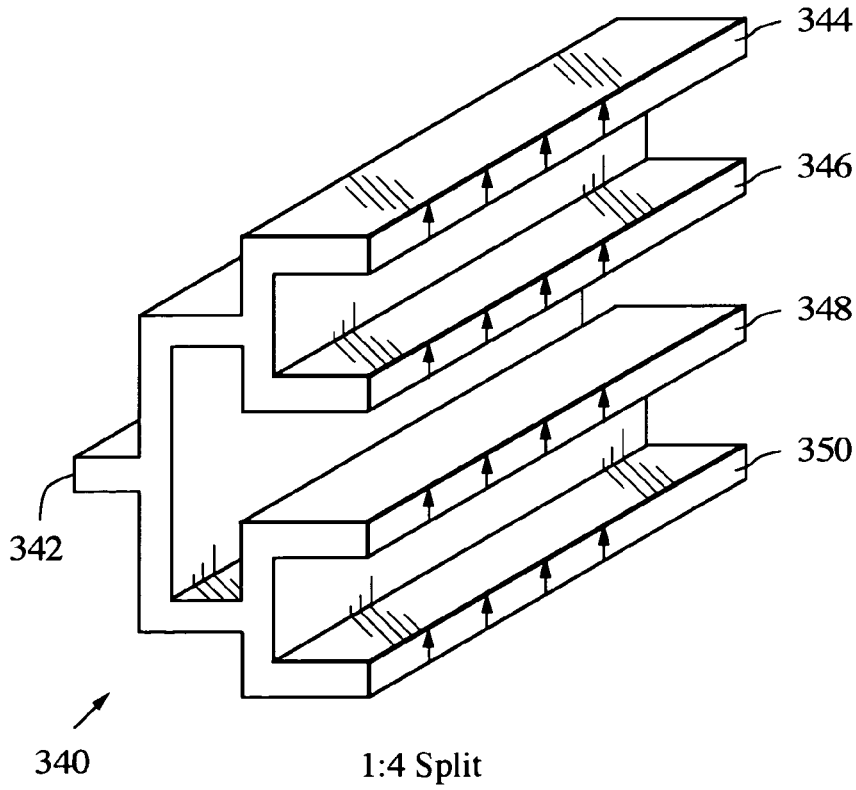
FIG. 10 is an isometric view of a simplified subarray structure comprising four stubs.

In an exemplary MMW application, all or portions of the feed network can be fabricated in a waveguide implementation. Consider, for example, the simple case of a subarray structure 300 comprising two stubs illustrated in FIG. 8. In this case, the structure is a waveguide structure, e.g. fabricated of an extruded or molded dielectric material whose outer surfaces are plated with an electrically conductive material such as copper or aluminum. An input/output slot 320 communicates with a waveguide section which into two waveguide channels 312, 314 which terminate in the stubs 316, 318. The surfaces of the slot 320 and stubs 316, 318 are not plated with the conductive material. A series feed 330 is shown in exploded view, and in this example is a waveguide structure having a series of slots 324-1, 324-2 . . . through which the I/O slot of the structure 310 is excited. The subarray structure can be extended to more slots. FIG. 9 shows a 1:4 subarray structure 340 with I/O slot 342 and four stubs 344–350. This can be extended further, e.g. to a 1:8 or 1:16 structure.

The waveguide network can alternatively be fabricated with a series of layers which together define conductive channels forming the transmission paths comprising the feed network, e.g. as illustrated in commonly owned U.S. Pat. No. 6,101,705.

In an exemplary embodiment, the antenna uses an innovative low cost, low loss CTS aperture for millimeter wave applications. A wave guide serpentine is used to provide the progressive phase to scan the beam in the H-plane of the antenna, so that discrete expensive phase shifters are not required to scan the beam.

Although the foregoing has been a description and illustration of specific embodiments of the invention, various modifications and changes thereto can be made by persons skilled in the art without departing from the scope and spirit of the invention as defined by the following claims.

What is claimed is:

1. A millimeter wave (MMW) antenna array, comprising:

a continuous transverse stub (CTS) radiating aperture comprising a set of spaced continuous transverse stubs, each having a longitudinal extent, wherein said radiating aperture comprises a waveguide structure comprising an upper conductive plate structure defining the set of continuous transverse stubs and a lower conductive plate structure disposed in a spaced relationship relative to the upper plate structure;

an excitation source for providing excitation signals in a MMW frequency range;

a feed system coupled to the excitation source for exciting the stubs with MMW electromagnetic energy having a linear phase progression along the longitudinal extent of the stubs to produce an array beam which is scanned over a beam scan range by changing the frequency of the excitation source, wherein the feed system includes a sinuous feed network coupled to a plurality of feed elements to provide a linear progressive phase shift in the electromagnetic wave along the feed source.

2. The array of claim 1, wherein the feed system comprises a feed network for launching a parallel plate mode electromagnetic wave into the waveguide structure at an end of the waveguide structure.

3. The array of claim 1, wherein the plurality of feed elements have a nominal spacing of one half wavelength at an operating frequency, and wherein respective adjacent feed elements are connected by a length of the sinuous feed network having a nominal electrical length of an integer wavelength multiple at an operating frequency in said MMW frequency range.

4. The array of claim 1, wherein the sinuous feed network has an input/output port at a first end, and a termination at a distal end.

5. The array of claim 1, further comprising:

a transmit/receive module coupled to an input/output port of a sinuous feed.

6. The array of claim 1, wherein the sinuous feed network includes a plurality of transition ports, the feed system further comprising a plurality of transmit/receive modules, each module respectively coupled between a transition port and a corresponding feed element.

7. The array of claim 1, wherein the excitation source is scannable over the MMW frequency range to produce a scanned frequency output signal as a function of time.

8. A W-band antenna array, comprising:

a continuous transverse stub (CTS) radiating aperture comprising a two-dimensional set of CTS subarrays arranged in rows and columns, each subarray comprising a set of spaced continuous transverse stubs having a longitudinal extent; and a feed system coupled to an excitation source for exciting the stubs with W-band electromagnetic energy having a linear phase progression along the longitudinal extent of the stubs to produce an array beam which is scanned along a first direction over a beam scan range by changing an operating frequency of the excitation source over a W-band frequency range, wherein the feed system includes a sinuous feed network coupled to a plurality of feed elements to provide a linear progressive phase shift.

9. The array of claim 8, wherein the plurality of feed elements have a nominal spacing of one half wavelength at an operating frequency, and wherein respective adjacent feed elements are connected by a length of the sinuous feed network having a nominal electrical length of an integer wavelength multiple at the operating frequency.

10. The array of claim 8, wherein the sinuous feed network has an input/output port at a first end, and a termination at a distal end.

11. A W-band antenna array, comprising:

a continuous transverse stub (CTS) radiating aperture comprising a two dimensional set of CTS subarrays arranged in rows and columns, each subarry comprising a set of spaced continuous transverse stubs having a longitudinal extent; and a feed system coupled to an excitation source for exciting the stubs with W-band electromagnetic energy having a linear phase progression along the longitudinal extent of the stubs to produce an array beam which is scanned along a first direction over a beam scan range by changing an operating frequency of the excitation source over a W-band frequency range, wherein the feed system includes, for a set of said subarrays arranged end to end along a longitudinal extent of the array for each subarray of said set, and input/output (I/O) port coupled to a subarray sinuous feed network and a plurality of spaced feed elements coupled to the sinuous feed network to provide a linear progressive phase shift for excitation signals applied to the subarray, a main (I/O) port, a series arrangement of delay lines connected to the main I/O port, and a coupler arrangement for coupling an end of each delay line to a corresponding one of the I/O ports of said set of subarrays.

12. The array of claim 11, wherein the linear progressive phase shift is 360 degrees at a predetermined operating frequency in said frequency range.

13. The array of claim 12, wherein the array beam is at broadside for said predetermined operating frequency, and said beam is moved away from broadside as the operating frequency is changed away from said predetermined operating frequency.

14. The array of claim 11, further comprising:

a respective subarray transmit/receive module coupled to an I/O port of subarray sinuous feeds.

15. The array of claim 11, further comprising:

a transmit/receive module coupled to the main I/O port.

16. The array of claim 11, further comprising a respective phase shifter coupled to an I/O port of subarray sinuous feeds to provide a means for scanning the beam along a scan range in a second direction transverse to the first direction.

* * * * *